United States Patent [19]

Bamber

[11] Patent Number: 5,017,327

[45] Date of Patent: May 21, 1991

[54] ADJUSTABLE LIGHT

[75] Inventor: David J. Bamber, Wichita, Kans.

[73] Assignee: Colemann Outdoor Products, Inc., Wichita, Kans.

[21] Appl. No.: 394,496

[22] Filed: Aug. 16, 1989

[51] Int. Cl.[5] ..... F21V 19/00

[52] U.S. Cl. ..... 362/389; 362/372; 362/399

[58] Field of Search ..... 362/188, 226, 285, 289, 362/372, 399

[56] References Cited

U.S. PATENT DOCUMENTS

| | | | |
|---|---|---|---|
| 1,220,395 | 3/1917 | Buchanan . | |
| 1,610,127 | 12/1926 | Godley . | |
| 2,186,439 | 1/1940 | Whalen . | |
| 2,212,975 | 8/1940 | Boynton | 362/289 |
| 2,217,790 | 10/1940 | Boynton | 362/289 |
| 3,428,800 | 2/1969 | Levin et al. | 362/289 X |
| 3,798,668 | 3/1974 | Hartmann | 354/149 |
| 4,410,933 | 10/1983 | Blake et al. | 362/371 |
| 4,429,471 | 2/1984 | Goodstine et al. | 34/10 |
| 4,536,832 | 8/1985 | Lemons | 362/289 X |
| 4,602,321 | 7/1986 | Bornhorst | 362/268 |
| 4,675,794 | 6/1987 | Fink, Jr. et al. | 362/289 |
| 4,692,844 | 9/1987 | Galerne | 362/3 |

FOREIGN PATENT DOCUMENTS 335539 4/1921 Fed. Rep. of Germany .

OTHER PUBLICATIONS

Brochure for "MAGNUM" Handheld—1,250,000 Candlepower Spot Only, no date given.

*Primary Examiner*—Stephen F. Husar

[57] ABSTRACT

A light includes an adjusting mechanism for focusing the light beam. The light includes a casing, a reflector mounted in the casing, and a piston housing mounted in the casing. A piston is slidably mounted in the piston housing and carries a bulb. A screw is rotatably mounted on the casing and is threadedly engaged with the piston. Rotation of the screw slides the piston and the bulb relative to the reflector to adjust the light beam.

12 Claims, 2 Drawing Sheets

3
4
4
3

ADJUSTABLE LIGHT

Background and Summary

This invention relates to an adjustable light, and, more particularly, to a light with an external adjusting knob for adjusting the light beam between a spot and a flood.

Adjustable lights with focusing mechanisms have been provided in the past. However, there is still a need for a reliable, easy-to-operate, economical focusing mechanism which can be easily assembled.

The invention provides an adjusting mechanism which can be preassembled and mounted in the casing of the light as a unit. The adjusting mechanism includes a piston housing and a piston which is slidably and non-rotatably mounted in the piston housing. The piston housing includes a tubular side wall and an end cap which is connected to the side wall. The forward end of the piston carries a bulb, and an internally threaded bore is provided in the rear end of the piston. A screw is threadedly engaged with the bore and includes a shank portion which extends through the end cap of the housing and through the casing of the light. An adjusting knob is mounted on the end of the shank, and rotation of the knob slides the piston and the bulb relative to the reflector of the light.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
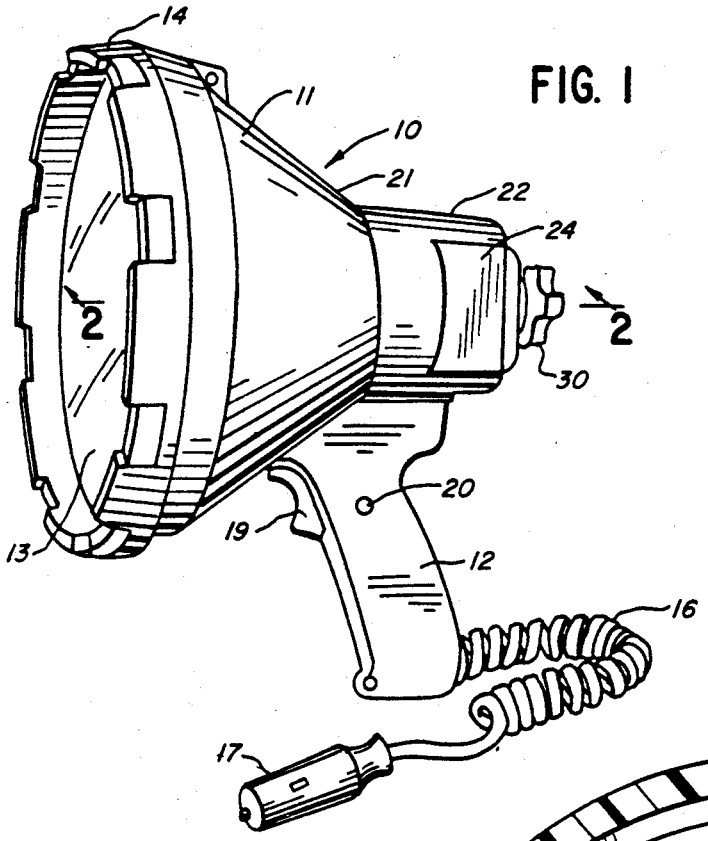
FIG. 1 is a perspective view of an adjustable light formed in accordance with the invention.

Referring to FIG. 1, an adjustable light 10 includes a casing 11, a pistol grip 12 for holding the light, and a lens 13 which is mounted on the front of the casing by a retaining ring 14. The particular light illustrated includes a 12 volt light bulb 15 (FIG. 2), and a power cord 16 for energizing the bulb. The light is adapted to be powered by a 12 volt power supply, and the power cord terminates in a plug 17 which can be inserted into the cigarette lighter of a vehicle. However, the invention can also be used in battery powered lights and in lights which use more or less volts.

The pistol grip 12 includes a trigger switch 19 for turning the light on. The switch can be locked in the on position by a pushbutton 20 on the pistol grip.

Figure 3:
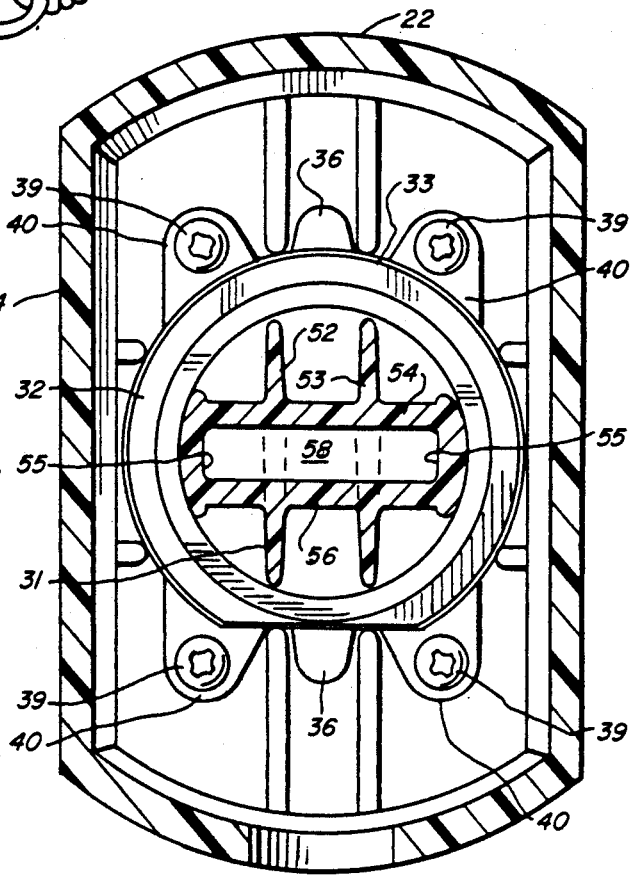
FIG. 3 is a sectional view taken along the line 3—3 of FIG. 2.
Figures 2, 4:
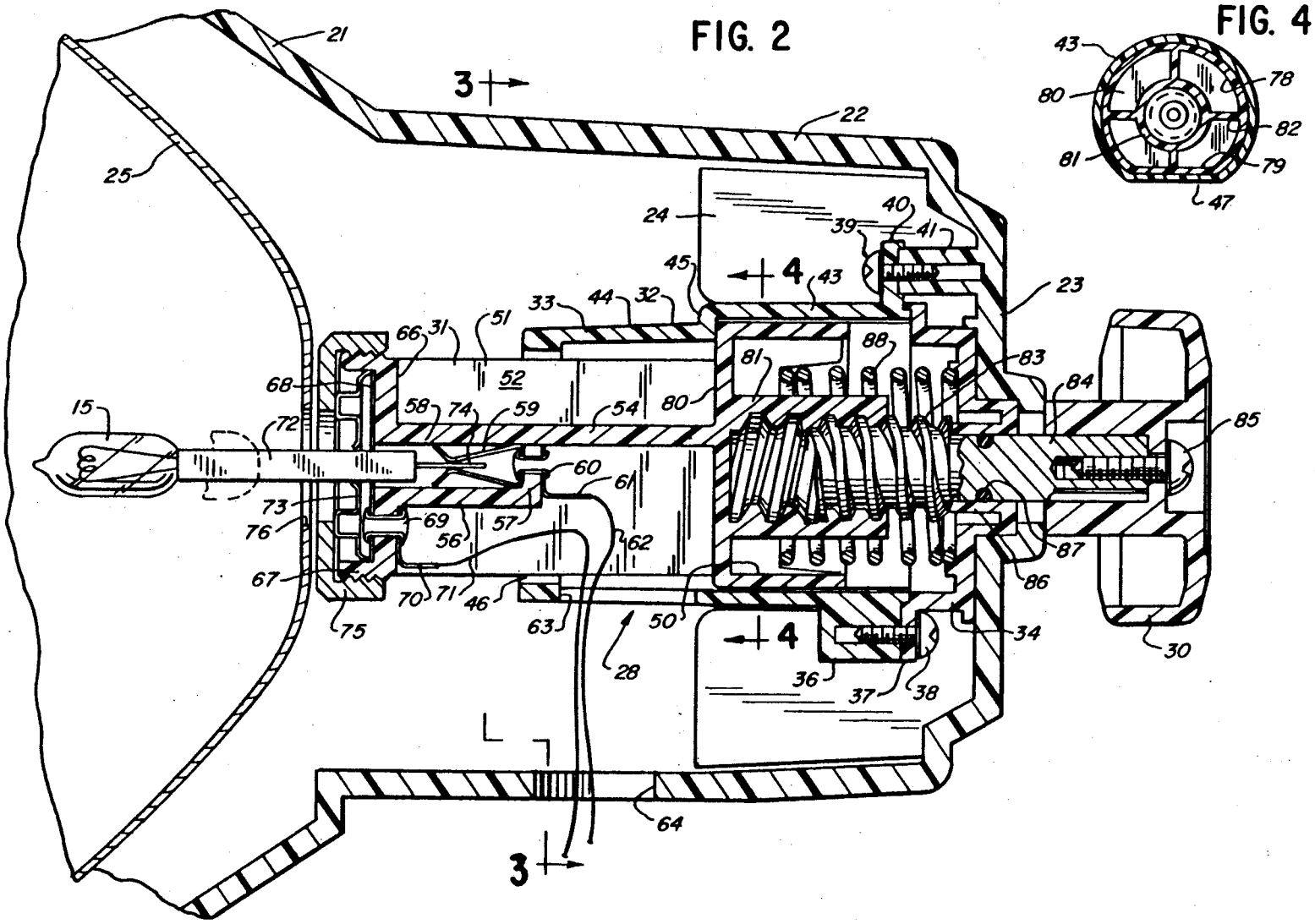
FIG. 2 is an enlarged fragmentary sectional view taken along the line 2—2 of FIG. 1.
FIG. 4 is a sectional view taken along the line 4—4 of FIG. 2.

The casing 11 includes a conical front portion 21 and a generally cylindrical rear portion 22 which terminates in a rear wall 23 (FIG. 2). The cylindrical portion includes a pair of flat side surfaces 24 (FIGS. 1 and 3) at the rear portion of the casing. A parabolic reflector 25 (FIG. 2) is mounted in the conical front portion of the casing and is maintained in position by the retaining ring 14.

Referring to FIG. 2, a light-adjusting assembly 28 is mounted within the casing and supports the light bulb 15 within the reflector 25. The light-adjusting assembly includes an adjusting knob 30 outside of the casing for adjusting the position of the bulb relative to the reflector. The particular bulb illustrated is a standard 100 watt halogen gas filled bulb, and one particular embodiment of the light developed 1.28 million candlepower of illumination.

The light bulb 15 is mounted on the forward end of an elongated piston 31 which is slidably mounted within a tubular piston housing 32. The piston housing 32 includes a tubular side wall 33 (see also FIGS. 3-5) and an end cap 34. The side wall and the end cap include a pair of outwardly extending tabs 36 and 37, respectively (FIG. 5), and the end cap is attached to the side wall by a pair of screws 38 which extend through the tabs. The piston housing is attached to the rear wall 23 of the casing by four screws 39 (FIG. 2) which extend through tabs 40 on the housing and into lugs 41 on the rear wall (see also FIGS. 3 and 5).

Figure 5:
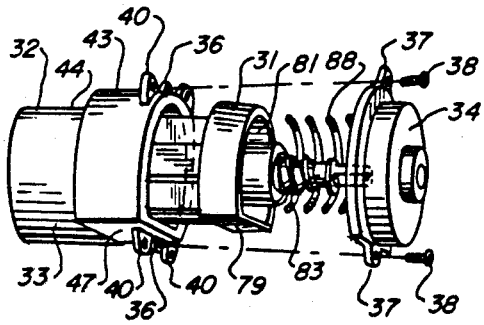
FIG. 5 is an exploded perspective view, partially broken away, of the adjusting mechanism.

The side wall 33 of the piston housing includes a rear portion 43 and a forward portion 44. The internal diameter of the forward portion 44 is smaller than the internal diameter of the rear portion 43, and the two portions are joined by a radially extending shoulder 45. The forward portion 44 is generally cylindrical and provides a circular front opening 46. The rear portion 43 is also generally cylindrical but has a flat side surface 47 (FIGS. 4 and 5).

The piston 31 includes a rear portion 50 and a forward portion 51. Referring to FIG. 3, the forward portion 51 is generally cruciform in transverse cross section and includes a pair of vertical ribs 52 and 53, a horizontal rib 54, and a pair of arcuate side surfaces 55 which are supported by the rib 54. A second horizontal rib 56 is spaced below the rib 54 and terminates in an end wall 57 (FIG. 2) to form a socket 58. A metal spring contact 59 is mounted on the end wall 57 by a rivet 60, and the contact is connected to the power supply by a tang 61 which is connected to the rivet and a wire 62 which extends through an opening 63 in the piston housing and an opening 64 in the casing.

The forward portion 51 of the piston terminates in a front wall 66 and an externally threaded cylindrical wall 67. A metal contact plate 68 is mounted on the front surface of the front wall 66 by a pair of rivets 69, and the contact plate is connected to the power supply by a tang 70 which is connected to one of the rivets and a wire 71.

The bulb 15 is a standard bulb and includes a metal base 72, a generally circular disc 73 which provides one of the terminals of the bulb, and a bayonet pin 74 which provides the other terminal. The bulb is mounted on the piston by inserting the bayonet pin into the socket 58 of the piston until the pin engages the spring contact 59 and the disc 73 engages the plate contact 68. An internally threaded retaining ring 75 is screwed onto the circular wall 67 to maintain the bulb in electrical contact with the contacts on the piston. The bulb extends through an opening 76 in the rear of the reflector 25.

The rear portion 50 of the piston 31 includes a generally cylindrical wall 78 (FIG. 4) which has a flat portion 79 which mates with the inside surface of the rear portion 43 of the piston housing. The wall 78 is joined to the front portion of the piston by a transverse wall 80 (FIG. 2), and an internally threaded sleeve 81 extends axially rearwardly from the wall 80. The sleeve is reinforced by four radially extending ribs 82 (FIG. 4).

The rear portion 50 of the piston supports the piston for axial sliding movement within the piston housing. The mating flat surfaces 79 and 47 of the piston and piston housing are engageable to prevent rotation of the piston relative to the piston housing. The arcuate surfaces 55 (FIG. 3) and the outer ends of the ribs 52 and 53 of the forward portion of the piston can be circumscribed by a circle having a diameter slightly less than the diameter of the circular front opening 46 of the piston housing.

The axial position of the piston is adjustable by a screw 83 which is screwed into the threaded sleeve 81 of the piston. The screw includes an unthreaded shank portion 84 which extends through openings in the end cap 34 of the piston housing and in the rear wall 23 of the casing. The adjusting knob is secured to the shank by a screw 85, and the knob is non-rotatably mounted on the shank by a flat surface on the shank and a key on the knob.

The axial position of the screw is fixed by the engagement between a collar 86 on the end cap 34 and the rear end of the threaded portion of the screw and by the engagement between the adjusting knob 30 and the rear wall 23 of the casing. An O-ring 87 is positioned in a groove in the shank of the screw and engages the collar 86 to maintain a snug fit between the shank and the collar. A coil spring 88 is mounted between the end cap 34 and the piston and resiliently biases the piston forwardly.

The bulb 15 is illustrated in its forwardmost position in FIG. 2 in which the bulb is positioned at the focal point of the parabolic reflector 25. The light from the bulb is thereby focused by the reflector into a relatively narrow beam or spot of maximum intensity. The bulb is prevented from moving forwardly of its FIG. 2 position by the engagement between the transverse wall 80 of the piston and the stop shoulder 45 on the piston housing.

The light beam can be changed from a spot to a flood by rotating the adjusting knob 30 to move the bulb rearwardly. Clockwise rotation of the knob causes clockwise rotation of the screw 83. Since the screw is fixed against axial movement, rotation of the screw moves the piston axially rearwardly within the piston housing. As the piston moves rearwardly, the bulb moves away from the focal point of the reflector, and the light beam becomes unfocused and begins to spread. The rear position of the bulb is indicated in phantom in FIG. 2 and is determined by the engagement between the rear end of the cylindrical wall 78 of the piston and the end cap 34. The bulb can be returned to its original position by rotating the adjusting knob counterclockwise, and the bulb can be positioned at any intermediate position in order to provide the desired beam. In one specific embodiment the screw moved 8.0 mm between its forward and rear positions, and the pitch of the screw was such that the adjusting knob rotated 320° between the front and rear positions.

Referring to FIG. 5, the adjusting assembly 28 can be independently assembled by inserting the piston 31 into the piston housing 32, screwing the screw 83 into the threaded bore 81 of the piston, positioning the spring 88 around the bore 81 and the screw, and attaching the end cap 34. Thereafter, the bulb 15 can be inserted into the socket of the piston and retained by the retaining ring 75. The adjusting assembly is attached to the casing 11 by inserting the end of the shank 84 of the screw through the opening in the rear wall of the casing and securing the piston housing to the casing by the screws 39. The screw is rotated to its rear position, and the adjusting knob 30 is mounted on the shank of the screw.

The casing 11 and the piston housing 32 are advantageously molded from plastic material such as high temperature polycarbonate. The piston 31 is advantageously integrally molded from high temperature glass-filled nylon. The screw 83 can be formed of any suitable material, for example, brass.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. An adjustable light comprising a casing, a reflector mounted on the casing, a piston housing mounted in the casing, a piston slidably and non-rotatably mounted in the piston housing and having an internally threaded bore, the piston housing and the piston having flat surfaces which are engageable with each other for preventing relative rotational movement between the piston and the piston housing, a bulb carried by the piston, a screw rotatably mounted in the casing and being restrained against axial movement, the screw being threadedly engaged with the bore of the piston, and a knob connected to the screw and positioned outside of the casing whereby rotation of the knob rotates the screw and slides the piston and the bulb relative to the reflector.

2. The structure of claim 1 including stop means on the piston housing for limiting the sliding movement of the piston.

3. The structure of claim 1 including a radially inwardly extending shoulder on the piston housing which is engageable with the piston for limiting sliding movement of the piston.

4. The structure of claim 1 in which the screw includes a threaded portion and a non-threaded shank portion which extends through the casing, the diameter of the shank portion being less than the diameter of the threaded portion, the knob being mounted on the shank portion and having a diameter greater than the shank portion, the casing including a rear portion which is positioned between the threaded portion of the screw and the knob in abutting relationship whereby axial movement of the screw relative to the casing is restrained.

5. The structure of claim 4 including a spring between the rear portion of the casing and the piston for resiliently biasing the piston away from the rear portion of the casing.

6. An adjustable light comprising a casing having front and rear portions, a reflector mounted on the front portion of the casing, a piston housing mounted on the rear portion of the casing, the piston housing having a side wall and an end cap, a piston mounted in the piston housing for axial sliding movement, means on the piston housing and the piston for preventing relative rotational movement between the piston and piston housing, the piston having a pair of ends and an internally threaded bore on one end facing the end cap of the piston housing, a bulb mounted on the other end of the piston, a screw having a threaded portion which is threadedly engaged with the bore of the piston and a shank portion which extends through the end cap of the piston housing and the rear portion of the casing, and a knob mounted on the shank portion of the screw outside of the casing thereby rotation of the knob rotates the screw and slides the piston and the bulb relative to the reflector.

7. The structure of claim 6 in which the piston housing is removably attached to the rear portion of the casing.

8. The structure of claim 6 in which the end cap of the piston housing is removably attached to the side wall of the piston housing.

9. The structure of claim 6 including a spring mounted within the piston housing and engaging the end cap of the piston housing and the piston for resiliently biasing the piston away from the end cap.

10. The structure of claim 6 in which the side wall of the piston housing is generally cylindrical, said means for preventing relative rotational movement between the piston and the piston housing comprising flat surfaces on the piston and the side wall of the piston housing which are engageable with each other.

11. The structure of claim 10 in which the side wall of the piston housing includes a radially inwardly extending shoulder which is engageable with the piston for limiting sliding movement of the piston toward the front portion of the casing.

12. The structure of claim 11 including a stop surface on the end cap of the piston housing which is engageable with the piston for limiting sliding movement of the piston toward the rear portion of the casing.

* * * * *

UNITED STATES PATENT AND TRADEMARK OFFICE

CERTIFICATE OF CORRECTION

PATENT NO. : 5,017,327

DATED : May 21, 1991

INVENTOR(S) : David J. Bamber

It is certified that error appears in the above-identified patent and that said Letters Patent is hereby corrected as shown below:

Col. 5, line 4 change "thereby" to --whereby--.

Signed and Sealed this

Twenty-second Day of September, 1992

*Attest:*

DOUGLAS B. COMER

*Attesting Officer*

*Acting Commissioner of Patents and Trademarks*